US005335621A

United States Patent [19]

Willis et al.

[11] Patent Number: 5,335,621

[45] Date of Patent: Aug. 9, 1994

[54] FLAG SUPPORT SYSTEM

[75] Inventors: Tucker Willis; James Cinquemani, Jr., both of Dallas, Tex.

[73] Assignee: Chaenomeles, Inc., Dallas, Tex.

[21] Appl. No.: 42,155

[22] Filed: Apr. 2, 1993

[51] Int. Cl.[5] ..... G09F 17/00

[52] U.S. Cl. ..... 116/173; 116/174

[58] Field of Search ..... 116/173, 174

[56] References Cited

U.S. PATENT DOCUMENTS

| | | | |
|---|---|---|---|
| 1,119,147 | 12/1914 | Fillmore | 116/174 |
| 1,311,712 | 7/1919 | Power | 116/174 |
| 1,338,210 | 4/1920 | Buckley | 116/173 |
| 2,794,414 | 6/1957 | Reifschneider | 116/173 |
| 5,156,110 | 10/1992 | Fuller | 116/173 |

FOREIGN PATENT DOCUMENTS

| | | | |
|---|---|---|---|
| 0145273 | 5/1954 | Denmark | 116/173 |
| 0296292 | 7/1915 | Fed. Rep. of Germany | 116/174 |
| 0838460 | 3/1939 | France | 116/173 |
| 0182916 | 3/1936 | Switzerland | 116/173 |

OTHER PUBLICATIONS

Eder Flag Mfg. Co., Inc., Oak Creek, Wisconsin Catalog, 1991, pp. 18–19, 56, 61–62, 68, 73, 75.

Flagpole Components, Inc., Addison Texas, Catalog #2, 1992, pp. 2, 8, 13.

Dettra Flag Company (D.F.C.) Catalog, 1991, pp. 5–7, 43, 45, 49, 64.

EMC A Div. of Eder Mfg. Corp. Custom Flags & Banners/Flagpoles & Accessories, 1991, pp. 60–61.

Concord Industries, Inc., Addison, Texas, Flagpoles Catalog, 1992, pp. 15–16.

*Primary Examiner*—William A. Cuchlinski, Jr.
*Assistant Examiner*—Willie Morris Worth
*Attorney, Agent, or Firm*—Johnson & Gibbs

[57] ABSTRACT

A flag support system comprising a staff, a base for mounting the staff to a vertical surface and a drop weight for maintaining tension upon the bottom end of the flag in its angulated position. A finial is disposed at the top end of the staff, which finial, drop weight and base element have a common configurational aspect for enhancing the appearance of the flag staff assembly as a whole as well as the functionality thereof.

22 Claims, 1 Drawing Sheet

FLAG SUPPORT SYSTEM

BACKGROUND OF THE INVENTION

1. Field of the Invention

The present invention relates to flag support systems and, more particularly, to a flag staff system incorporating an angulated staff utilizing an ornamental drop weight to effect tension on the heading of the flag during its extension from the staff.

2. History of the Prior Art

Flags have been displayed for centuries in one form or another. The contemporary form of a flag display incorporates a generally rectangular cloth member having the appropriate indicia formed thereon and suspended from a vertically disposed flag pole or an angulated staff. The flag staff generally extends outwardly from a vertical surface, such as a building wall or vertical column, whereas flag poles are mounted in the ground. Typically, vertical flag poles are rather large in construction and are used for large residential structures, as well as a myriad of commercial areas. The staff for use in presenting a flag in an angulated configuration relative to a vertical surface is generally of a shorter length and adapted for support of a flag therefrom.

A variety of systems have been developed for positioning and securing flags to vertical, horizontal, and angulated flag suspension arrangements. In the main, the systems include a means for maintaining a degree of tautness at the bottom of the flag nearest the support member. In upstanding flag poles, the securing system may include retainer loops appropriately securing the top and bottom of the heading of the flag about the flag pole and/or weight members that may depend from the generally horizontally disposed flag. The weight members provide a means for maintaining a degree of tension in the flag in a manner that allows some degree of movement. Such retainer loops are currently in use by commercial enterprises, such as banks, for vertical flag poles.

Staffs used for angulated display of flags are not as well equipped with regard to means for maintaining the tautness at the bottom of the flag. In certain instances, ropes have been used to secure the flag about the flag staff but various disadvantages are associated therewith. Not the least of these disadvantages is the aesthetic appearance of such a rope around the flag staff. However, in most cases on a staff the flag is secured by a halyard with snaps for the top and bottom attachment holes. This also has disadvantages. The use of other tensioning devices has apparently not been accepted in prior art flag assemblies. It would be an advantage to incorporate a system utilizing the distinct advantages of the prior art flag support systems with the multitude of additional advantages in accordance with the principles of the present invention.

The present invention overcomes the problems of the prior art by providing a flag staff support system utilizing a counter weight that may be disposed upon or adjacent the bottom corner of the heading of a flag disposed relative to the angulated staff. The flag is loosely mounted to the staff, by a ring or the like, to permit the weight to induce tautness in the attached bottom of the flag.

SUMMARY OF THE INVENTION

The present invention relates to flag staff assemblies. More particularly, one aspect of the invention includes a flag staff assembly comprising an elongate staff adapted for the support of a flag in an angulated position relative to the horizontal, means for mounting the staff in an angulated position relative to an adjacent surface, means for securing the top end of a flag to the top of the staff, and means for mounting the bottom end of the flag to an intermediate bottom of the staff. A second means for mounting the bottom end of the flag to an intermediate portion of the staff includes a weight member for depending from the flag with the flag suspended or depending from the staff in an angulated position.

In another aspect, the above described invention includes a decorative assembly comprising an ornamental base member adapted for securing the staff to a generally vertical surface and wherein the weight member is constructed of an aesthetically pleasing configuration having dimensional and/or configurational similarities to the base member. In yet another embodiment of the invention, the top end of the flag staff receives an ornamental member having aesthetic similarities to the base member and the weight member. A set screw may also be used to secure the flag staff in the base member.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
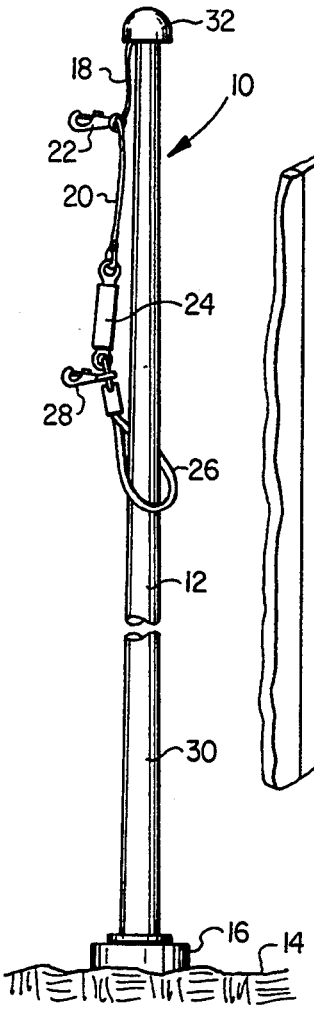
FIG. 1 (PRIOR ART)
FIG. 1 is a side-elevational view of a prior art flag pole assembly illustrating various aspects thereof.

Referring first to FIG. 1, there is shown a prior art flag pole assembly 10 incorporating an upstanding flag pole 12 secured into the ground 14 by a base 16. The flag pole assembly 10 further includes a flag support structure in the form of an internal halyard 18. A lanyard 20 and a snap 22 are disposed on the distal end of the halyard 18, and a weight 24 is disposed on the distal end of the lanyard 20. Further, a retaining loop 26 and a snap 28 are disposed on the distal end of the weight 24. Also, a decorative cap 32 is disposed on the upper end of the flag pole 12 and covers the access to the halyard 18. A flag (not shown) is secured to the snaps 22, 28 and is supported from the flag pole 12 in display of the indicia thereon.

Conventional flag poles, such as the flag pole assembly 10, have numerous features that permit ease in the assembly to, and presentation of, the flag thereon. Both the size and the shape of the flag pole have improved over the years and today include various attractive design features and enhanced finishes. One of the more significant aspects of the flag pole is the internal halyard 18 and the suspension of the flag therefrom. The internal halyard 18 is generally utilized with conventional flag poles and permit ease in the support of the flag from the pole. Further, the internal halyard 18 substantially reduces the availability of the halyard system for vandalism. The internal halyard 18 is of course more aesthetically appealing than an external halyard.

Flag poles are conventionally utilized to display flags and/or decorative members therefrom. In that regard, the flag pole 12 generally incorporates an attractive finish upon an outer surface 30 and a corresponding decorative cap 32 disposed on the upper end of the flag pole. In the prior art illustration of FIG. 1, the weight 24 is attached to the lanyard 20 and then to the halyard 18 and generates tension upon the halyard 18 to allow a flag to be lowered under its own weight when utilizing the internal halyard 18. The weight 24 also imparts a tension from the bottom end to the top end of a flag to maintain a tautness theredown. By utilizing a counterweight, the retaining loop 26 may be utilized therebeneath for securing the lower portion of the weight 24 to the flag pole 12. In earlier versions of flag pole assemblies, an external halyard was utilized and the lower snap 28 was generally secured to a portion of the halyard, and the halyard was usually tightened from near the base 16 of the flag pole 12 by wrapping such around a cleat. These are all conventional elements of flag pole systems and are described and/or illustrated herein for purposes of reference.

Figure 2:
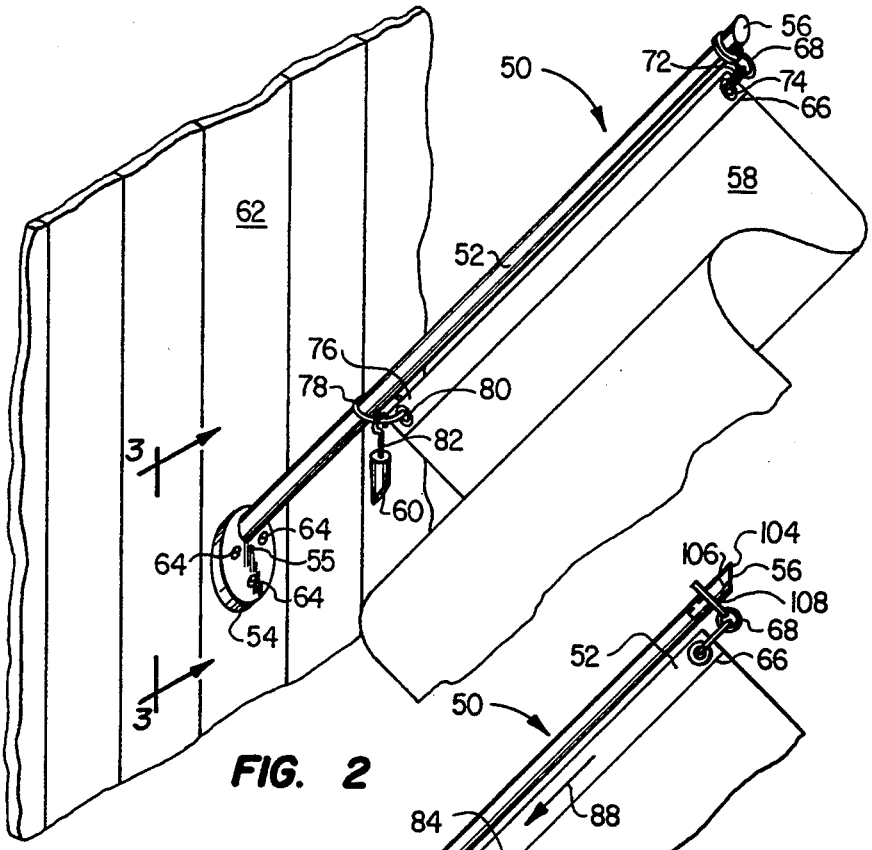
FIG. 2 is a perspective view of one embodiment of a flag staff assembly constructed in accordance with the principles of the present invention and illustrating a flag in association therewith.

Referring now to FIG. 2, there is shown a flag staff assembly 50 constructed in accordance with the principles of the present invention. The flag staff assembly 50 incorporates an elongate staff 52, a base or mounting member 54 an end piece or finial 56, and a weight 60. The finial 56 is an ornament added to the flag staff for decoration and as a means for supporting the top end of the flag. A flag 58 is shown secured to the staff 52 with the weight 60 depending therefrom. In the configuration shown herein, both functional and aesthetic advantages are provided.

Still referring to FIG. 2, the flag staff assembly 50 is positioned against, and secured to, a vertical wall 62. The base 54 is secured to the vertical wall 62 by plurality of fastening elements or screws 64 extending therethrough. Likewise the staff 52 is secured within the base 54 by a set screw 55. This is but one embodiment of a securement option and the fastening element of the base 54 may also be assembled from behind in an alternative embodiment. A top end 66 of a seamed proximal edge of the flag 58 is secured to the staff 52 by a mounting ring 68. The mounting ring 68 is attached to the finial in various methods, such as that shown herein. A fastening member 72 connects the mounting ring 68 to an eye 74 formed in the top end 66 of the flag 58. The bottom end 76 of the proximal edge of flag 58 is secured to the staff 52 by a fastening ring 78 that extends through an eye 80 disposed in the bottom end of the flag 58, and around the staff 52 with the weight 60 depending therefrom. The weight 60 is connected to the fastening ring 78 by a connector 82. The connector 82 is shown assembled to the fastening ring 78 for purposes of illustration. It should be noted that the connector 82 could easily be received directly within the eye 80 to apply the necessary tension to the flag 58, as will be described below.

Figure 3:
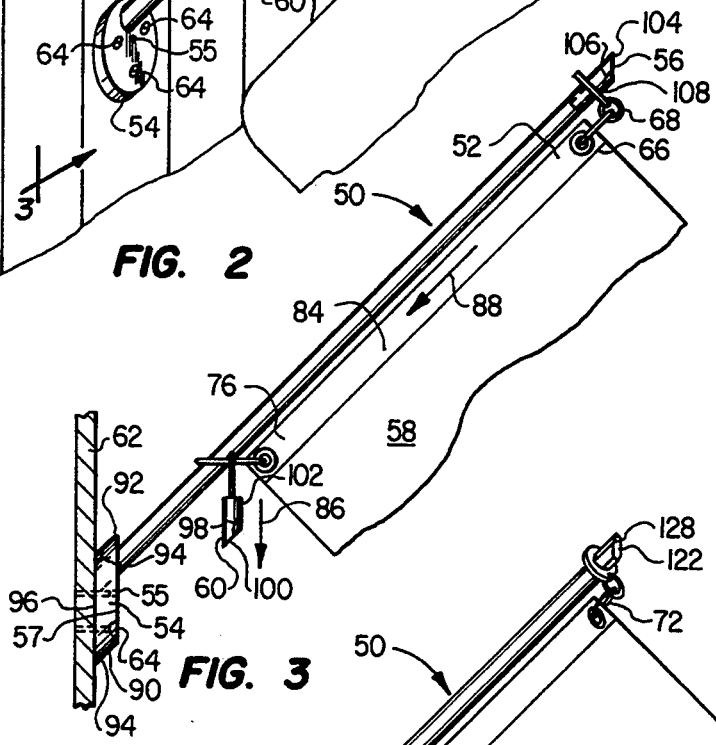
FIG. 3 is a side-elevational view of the flag staff assembly of FIG. 2.

Referring now to FIG. 3, there is shown a side-elevational, cross sectional view of the flag staff assembly 50 of FIG. 1 taken along lines 3—3 thereof. The flag staff assembly 50 is shown to be mounted to the vertical wall 62 by the fastening elements 64 as described above. The set screw 55 is also shown by dotted lines. The base 54 is also shown with dotted lines illustrating a plurality of countersunk apertures 57 adapted for receiving, and engagement with, the fastening elements 64 therein. Of course, in another embodiment the fastening assembly could be disposed behind the face of the base. More particularly, FIG. 3 illustrates that tension is maintained on bottom end of a heading 84 of the flag 58 by the weight 60 depending therefrom and applying a downward force in the direction of an arrow 86. The top end 66 of the heading 84 of the flag 58 is secured by the mounting ring 68 connected to the finial 56 as described above. A force indicated by arrow 88 is provided by the pull of gravity upon the weight 60. Unlike prior art flag staff arrangements, the flag 58 is therein assembled to the staff 52 while maintaining a taut heading 84 thereacross. The weight 60 acts upon the bottom end 76 of the flag 58 in an angulated relationship. Unlike the weight 24 of FIG. 1, the weight 60 is not part of a halyard system for mounting the flag 58 and i s provided sol el y for the purpose of maintaining tautness across the heading 84, as well as the aesthetic appearance thereof.

Referring still to FIG. 3, it may be seen that the weight 60, base 54 and finial 56 are all constructed with a common aesthetically pleasing design element. These parts could be machined, cast, coined, rolled or otherwise formed with similar aesthetic features. The parts may also be formed from brass, copper, bronze, steel, iron, aluminum, fiberglass, polymers and the like. In the present embodiment, the base 54 comprises a member having angulated side walls 90 and 92 disposed in generally parallel spaced relationship and at an angle 94 relative to a backwall 96 that is substantially identical to an angle 98 defined between a surface 100 and a cylindrical side wall 102 of the weight 60 adjacent thereto. Likewise, the finial 56 has a surface 104 that forms an angle 106 with a cylindrical side wall 108 that is also substantially identical or similar to the angles 94 and 98. In a preferred embodiment, the finial, base and weight 56, 54 and 60, respectively, are made of similar material, such as brass with a similar finish to therein provide an aesthetically pleasing appearance to the flag staff assembly 50 and in the configuration affording functional utility of maintaining the tautness along the heading 84 of the flag 58.

Figure 4:
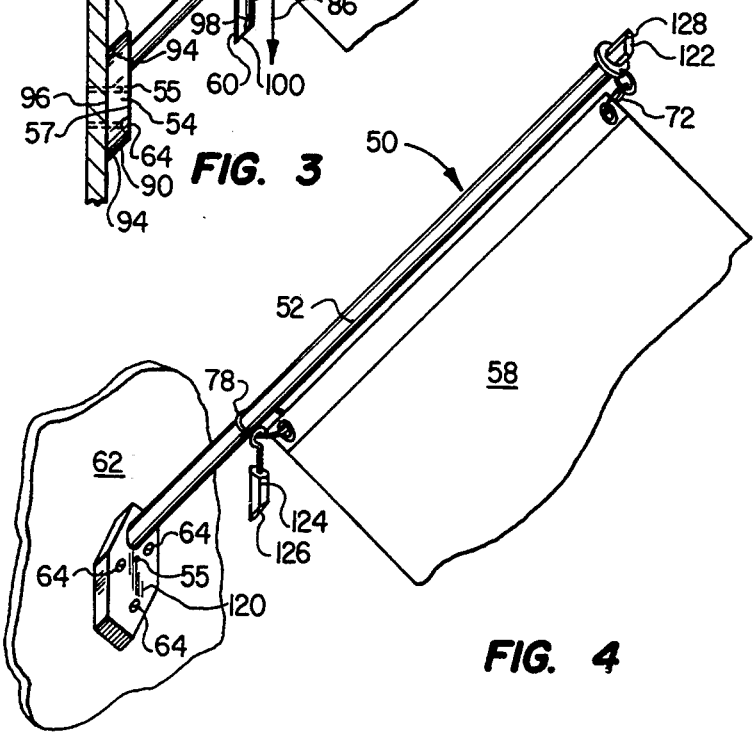
FIG. 4 is a perspective view of an alternative embodiment of the assembly of FIG. 2.

Referring now to FIG. 4, there is shown an alternative embodiment of the flag staff assembly 50 wherein a base 120 is utilized in conjunction with a finial 122 and a weight 124 each having common, or similar, aesthetic aspects thereof. The staff 52 is of course identical to that shown in FIG. 3 and the other attachment elements, such as the fastening member 72 and the fastening ring 78, are identical. What is not identical is the shape of the base 120, the shape of the weight 124 and the shape of the finial 122. In this particular embodiment, each of these elements incorporates a six-sided prismatic solid having an angulated side portion similar to the angulated side wall 90 of the base 54 discussed relative to FIG. 3. However, the weight 124 and the finial 122 are also constructed with six sides and an angulated bottom surface 126 to an angulated top surface 128 corresponding in the matter described relative to the surfaces 100 and 104, respectively, of FIG. 3. The base 120 is shown secured to the vertical wall 62 by the fastening elements 64.

In accordance with the principles of the present invention, the flag staff assembly 50 incorporates the three aesthetically matched elements of the base 120, the weight 124 and the finial 122 to provide, in conjunction with the staff 52, an assembly that is capable of supporting the flag 58 in an aesthetically pleasing and functionally correct configuration with advantages not heretofore found in flag staff assemblies. Of course, any size, shape or color of the finial, base and weight could be used. Likewise, any aesthetically pleasing similarity between the finial, base and weight could be utilized in accordance with the principles of the present invention.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

We claim:

1. An improved flag staff assembly of a type wherein an elongate flag staff is disposed at an angle relative to a generally vertical surface having means for supporting a seamed proximal edge of a flag therefrom and disposed at an angle relative to the ground, wherein the improvement comprises:

a base member adapted for securement to said vertical surface in support of said flag staff therefrom;

a finial adapted for securement to a top end of said flag staff;

a weight;

means for coupling said weight relative to a bottom end of said proximal edge of said flag for causing the proximal edge of said flag to become taut relative to said staff; and an upper member coupling a top end of the proximal edge of said flag to said finial and a lower member slidingly coupling a bottom end of the proximal edge of said flag to said flag staff.

2. The apparatus set forth in claim 1 wherein said weight includes a generally cylindrical member having an angulated end portion.

3. The apparatus set forth in claim 2 wherein said base member is constructed with angulated side walls generally matching said angulated end portion of said weight.

4. The apparatus set forth in claim 2 wherein said finial has an angulated top portion generally matching said angulated end portion of said weight.

5. The apparatus set forth in claim 1 wherein said upper and lower members are each shaped generally in the form of a ring.

6. The apparatus set forth in claim 5 wherein said weight includes coupling means adapted for engaging said bottom ring member.

7. The apparatus set forth in claim 1 wherein said base member, finial and weight are each constructed with a common configurational aspect for providing aesthetic similarity therebetween.

8. The apparatus set forth in claim 1 wherein at least one of said base member, finial and weight are formed of brass.

9. The apparatus set forth in claim 1 wherein at least one of said base member, finial and weight are formed of copper.

10. The apparatus set forth in claim 1 wherein at least one of said base member, finial and weight are formed of bronze.

11. The apparatus set forth in claim 1 wherein at least one of said base member, finial and weight are formed of iron.

12. The apparatus set forth in claim 1 wherein at least one of said base member, finial and weight are formed of aluminum.

13. The apparatus set forth in claim 1 wherein at least one of said base member, finial and weight are formed of fiberglass.

14. The apparatus set forth in claim 1 wherein at least one of said base member, finial and weight are formed of a polymer.

15. The apparatus set forth in claim 1 and further including means for securing said staff in said base member.

16. The apparatus set forth in claim 15 wherein said securing means includes at least one threaded fastener extending through said base member into contact with said staff disposed therein.

17. An improved method of suspending a flag from a flag staff supported at an angle relative to a generally vertical surface comprising the steps of:

providing a base member for securement to said vertical surface in support of said flag staff therefrom;

receiving said flag staff into said base member for support of said flag staff therefrom;

providing a finial adapted for securement to a top end of said flag staff;

securing said finial to the top end of said flag staff;

providing a weight adapted for mounting relative to said flag;

mounting a top end of a seamed proximal edge of said flag to said finial;

mounting a bottom end of said proximal edge of said flag to said weight and slidingly about a portion of said staff below said finial for suspending said flag therefrom; and suspending said flag from said flag staff with said weight exerting a downward force upon a bottom end of said flag and stretching said bottom end of said proximal edge of said flag downwardly at an angle from said finial.

18. The method as set forth in claim 17 and further including the steps of forming said base member with angulated side wall portions.

19. The method as set forth in claim 17 wherein said step of providing said weight includes the step of providing a generally cylindrical member having an angulated end portion.

20. The method as set forth in claim 19 and including the step of forming said base member with angulated side walls generally matching said angulated end portion of said weight.

21. The method as set forth in claim 19 and including the step of forming said finial with an angulated top portion generally matching said angulated end portion of said weight.

22. The method as set forth in claim 17 and further including the steps of providing a top ring member, coupling the top end of the proximal edge of said flag to said finial, providing a bottom ring member coupling the bottom end of the proximal edge of said flag to said flag staff.

* * * * *